US005537199A

United States Patent [19]

Takai et al.

[11] Patent Number: 5,537,199

[45] Date of Patent: Jul. 16, 1996

[54] COMPACT MULTI-FUNCTIONAL IMAGE FORMING APPARATUS

[75] Inventors: Yasuhiro Takai, Sakurai; Hirokazu Tanaka, Osaka, both of Japan

[73] Assignee: Sharp Kabushiki Kaisha, Osaka, Japan

[21] Appl. No.: 429,428

[22] Filed: May 1, 1995

[30] Foreign Application Priority Data

May 6, 1994 [JP] Japan ..... 6-094307

[51] Int. Cl.[6] ..... G03G 15/01

[52] U.S. Cl. ..... 355/326 R; 347/115; 355/200; 355/210; 355/327

[58] Field of Search ..... 355/200, 210, 355/211, 212, 326 R, 327, 328; 347/115, 172, 232

[56] References Cited

U.S. PATENT DOCUMENTS

| | | | |
|---|---|---|---|
| 3,654,654 | 4/1972 | Abreu et al. | 118/259 X |
| 3,924,945 | 12/1975 | Weigl | 355/258 |
| 3,937,572 | 2/1976 | Gaynor et al. | 355/212 X |
| 4,021,106 | 5/1977 | Gaynor | 355/200 |
| 4,027,964 | 6/1977 | Fantuzzo et al. | 355/258 |
| 4,804,994 | 2/1989 | Sasaki et al. | 355/251 |
| 4,851,926 | 7/1989 | Ishikawa | 3358/300 |
| 4,931,876 | 6/1990 | Hashizume | 358/300 |
| 5,053,821 | 10/1991 | Kunugi et al. | 355/245 |
| 5,138,387 | 8/1992 | Sato et al. | 355/251 |
| 5,159,389 | 10/1992 | Minami et al. | 355/211 |
| 5,172,163 | 12/1992 | Yamaoki et al. | 355/210 |
| 5,374,978 | 12/1994 | Asanae et al. | 355/210 |

FOREIGN PATENT DOCUMENTS

| | | |
|---|---|---|
| 60-59592 | 12/1985 | Japan . |
| 2-4900 | 1/1990 | Japan . |
| 6-118749 | 4/1994 | Japan . |

*Primary Examiner*—Matthew S. Smith
*Attorney, Agent, or Firm*—David G. Conlin; Brian L. Michaelis

[57] ABSTRACT

An image forming apparatus includes a photoreceptor formed by a transparent support member, a transparent conductive layer, an optical semiconductor layer, and an insulation layer stacked in this order, as well as developing units corresponding to black, yellow, magenta, and cyan provided at an outer periphery thereof. Exposure units corresponding to respective developing units are provided in the photoreceptor. Fixing units are arranged near respective developing devices at the outer periphery of the photoreceptor. Feeding units are provided for feeding a sheet A along the outer periphery of the photoreceptor from a paper feeding cassette to a first developing device and between the developing devices. Paper ejection units are provided corresponding to respective fixing units and sheet A is fed or ejected by switching the position of the fixing unit.

15 Claims, 16 Drawing Sheets

COMPACT MULTI-FUNCTIONAL IMAGE FORMING APPARATUS

BACKGROUND OF THE INVENTION

1. Field of the Invention

The present invention relates to image forming apparatuses used in a printer, a facsimile, a copying apparatus and the like employing electrophotographic system. More particularly, the present invention relates to an image forming apparatus by which single apparatus a black and white, multicolor, or bicolor image can be produced on a sheet of paper.

2. Description of the Background Art

The electrophotographic system to which Carlson process is applied is widely employed in conventional image forming apparatuses using toner. The principle thereof will be described by illustrating positive development system used in a copying apparatus or the like as an example. Referring to FIG. 13, an apparatus utilizing Carlson process includes a corona charger 2, an exposure device 3, a developing device 4, a transfer device 5, a fixing device 6, a cleaner 7, and a corona discharger 8 provided in this order around a photoreceptor drum 1 having a photosensitive layer on its surface.

In the structure above, the surface of photoreceptor drum 1 is uniformly charged by corona charger 2 in a dark place. By projecting an original image onto the surface of photoreceptor drum 1 by exposure device 3, charges are removed at the portion exposed to the light, thereby forming an electrostatic latent image on the surface of photoreceptor drum 1. Toner 9 charged to have the polarity opposite to that of charges on photoreceptor drum 1 is attached to the electrostatic latent image, so that a visible image is formed with toner 9. The visible image is superimposed on a sheet 10, and from the backside thereof charges with opposite polarity to toner 9 are applied by corona discharge using transfer device 5, thereby transferring a toner image to sheet 10. The transferred toner image is fixed to sheet 10 by means of heat, pressure and the like of fixing device 6 and becomes a permanent image. Residual toner 9*a* which has not been transferred to sheet 10 but remains on photoreceptor drum 1 is removed by cleaner 7. The electrostatic latent image on photoreceptor drum 1 is discharged by light emitted from corona discharger 8. Thereafter, the process starting from charging by corona charger 2 is repeated and images are formed successively.

In the electrophotographic system to which Carlson process is applied, a corona discharger is usually employed so as to charge photoreceptor drum 1 or to transfer toner 9 to sheet 10. Corona discharge requires application of a high voltage of several KV, and is easily influenced by environmental change, such as a change in temperature which brings about fluctuation in the amount of charges on the surface of photoreceptor drum 1. In addition, ozone is generated by corona discharge, giving rise to an environmental problem.

In view of the foregoing, an image formation method which does not require corona charge described above is disclosed in Japanese Patent Publication No. 2-4900. FIGS. 14A–14C show the image formation method disclosed in Japanese Patent Publication No. 2-4900. Referring to FIGS. 14A–14C, a photoreceptor 11 is formed by a transparent substrate 12 of glass or the like, a transparent conductive layer 13 of $In_2O_3$ or the like, a photoconductive layer 14 of Se or the like, and an insulation layer 15 of polyethylene telephtalate film or the like, stacked in this order. When a magnet 17 having conductive magnetic toner 16 attached thereto and serving as a toner retainer is brought near the surface of photoreceptor 11, and light is directed from the side of transparent substrate 12 with a voltage applied between magnet 17 and transparent conductive layer 13, electric resistance of photoconductive layer 14 is reduced at the portion exposed to the light, and charges are introduced up to portion under insulation layer 15. As a result, a strong electric field is generated between magnet 17 and photoreceptor 11 and charges with the opposite polarity are introduced to a portion of toner 16 corresponding to the exposed region. Consequently, charges of toner 16 and charges introduced from transparent conductive layer 13 form charge pairs of opposite polarities, thereby attracting each other. Even if magnet 17 is moved away from photoreceptor 11 thereafter, only the portion of toner 16 corresponding to the exposed region remains on the surface of the photoreceptor.

In accordance with the principle above, a toner image can be formed on the surface of photoreceptor 11 without employing a corona charge method. After the toner image is formed on the surface of photoreceptor 11, it is transferred from the surface of photoreceptor 11 to the surface of a sheet (not shown). Toner is then heated, fused and fixed onto the sheet, on which an image can be formed as a permanent image.

An apparatus for forming a multicolor image which utilizes a principle similar to that in above-mentioned Japanese Patent Publication No. 2-4900 is disclosed in Japanese Patent Publication No. 60-59592. FIG. 15 is a schematic cross sectional view of an apparatus for forming an image with three kinds of toner, disclosed in the above publication. Referring to FIG. 15, toner 20, 21 and 22 having different colors, developing devices with a magnetic brush 26, 27 and 28, a back electrode 29, a light emitting diode 30, and a cleaner 32 are provided around photoreceptor 11. As photoreceptor 11 rotates, toner images 23, 24 and 25 are successively formed with toner 20, 21 and 22 at portions in contact with developing devices 26, 27 and 28 respectively, and three toner images 23, 24 and 25 formed on photoreceptor 11 are transferred to a sheet 31 and then fixed thereto.

FIG. 16 schematically shows a structure of another exemplary apparatus for forming a multicolor image which utilizes principle similar to Japanese Patent Publication No. 2-4900. Referring to FIG. 16, an apparatus 200 for forming a multicolor image includes a photoreceptor drum 201 and four developing devices 202–205 for multicolor printing, for example, provided around photoreceptor drum 201. In photoreceptor drum 201, an exposure device 206 is rotatably provided so as to take an appropriate position with respect to respective developing devices. Images are transferred color by color to a sheet 209 by a transfer roller 207, fixed by a fixing roller 208 and recorded on sheet 209. A mechanism is provided for moving the developing device not used for recording away from photoreceptor drum 201 in the directions indicated by allows in the figure. Sheet 209 is guided by a pull-in claw 210 and guide plates 211 and 212, and passes over transfer roller 207 the number of times required for printing. After the sheet is printed the required number of times, pull-in claw 210 is closed, so that sheet 209 is ejected.

Although the multicolor image formation apparatus described above can be made compact thanks to reduction in the number of components around photoreceptor drum 1 and it can produce multicolor, monocolor and black and white images, it has the following problems.

(1) When a multicolor image is to be formed, sheet 209 must move a plurality of times over transfer roller 207, and thus formation of an image requires a long time.

(2) The photoreceptor rotates and the outer peripheral surface thereof contacts the developing units for respective colors. As a result, developer (including toner) contacts the photoreceptor more than necessary, and toner attaches to a region which need not be developed, thereby generating a fog. In addition, when the toner on the development roller is isolated from the photoreceptor, it is blown off to inside of the apparatus by the wind generated by rotation of the photoreceptor, which is a main cause for scattering of toner.

(3) Even after an image is developed at a first developing unit, the photoreceptor is still in contact with developer thereof, whereby it requires cleaning after development. As a result, a desired hue cannot be obtained and the hue obtained at a second developing unit is a mixture of the original hue of second developer and that of first developer, leading to an undesirable change of the original hue of developer.

(4) The rotating photoreceptor degrades because of charge introduction and wear caused by the contact with developer. The toner on the photoreceptor adversely affects surrounding components due to a slight increase in temperature of the photoreceptor caused by a heat source for fixing, eventually resulting in heat history degradation of the photoreceptor. Since use of such a degraded photoreceptor adversely affects the image quality and the like, photoreceptors must be replaced frequently.

(5) Upon feeding a sheet to the photoreceptor, in order to align the leading edges of an image region and the sheet, timing of feeding the sheet must be accurately synchronized with rotation of the photoreceptor, which requires complicated control. Consequently, deviation of mispositioning of an image is very likely.

(6) Since mixing of developers is prevented by moving developing devices, a complicated structure is required.

(7) As a transfer roller for transferring an image from the photoreceptor to the sheet is provided, a transfer mechanism is needed. Therefore, control for transfer operation is required, resulting in complicated structure and an increase in cost.

SUMMARY OF THE INVENTION

One object of the present invention is to allow reduction in cost in a compact multi-functional image forming apparatus.

Another object of the present invention is to prolong life of a photoreceptor drum in the compact multi-functional image forming apparatus.

A still further object of the present invention is to prevent degradation of the photoreceptor drum in the compact multi-functional image forming apparatus.

Yet another object of the present invention is to simplify a structure in the compact multi-functional image forming apparatus.

A further object of the present invention is to prevent scattering of toner in the compact multi-functional image forming apparatus.

A further object of the present invention is to ensure prevention of mixing of toner in the compact multi-functional image forming apparatus.

The above objects of the present invention is achieved by an image forming apparatus including a stationary transparent photoreceptor drum having a cylindrical shape, and an exposure unit disposed in the photoreceptor drum for forming a latent image for each of the prescribed color components on an outer peripheral surface of the photoreceptor drum. At the outer periphery of the photoreceptor drum, there are provided a developing device for developing a latent image for each of the prescribed color components on the drum and a plurality of fixing devices provided adjacent to the developing device. A sheet is fed to the photoreceptor and subjected to exposure, development, and fixation in this order for each of the prescribed color components. The transparent photoreceptor drum is stationary. A latent image is formed on the outer peripheral surface of the photoreceptor by the exposure unit provided inside the photoreceptor drum, and the latent image is recorded onto the sheet by the developing device and the fixing device provided at the outer periphery of the photoreceptor drum. Since the photoreceptor drum does not rotate as a conventional one, a driving portion for the photoreceptor drum is not necessary. Furthermore, the apparatus can be made compact because the exposure unit is provided inside the transparent photoreceptor drum. As a result, reduction in cost can be achieved in a compact, multi-functional image forming apparatus.

Preferably, the developing device includes a container for retaining developer, a supply roller for supplying developer from the container to the photoreceptor drum, and a shutter provided to contact with the supply roller for stopping supply of developer to the photoreceptor drum. The supply of developer to the photoreceptor drum is stopped by operating the shutter as required. Consequently, supply of developer to photoreceptor drum can be controlled with a simple structure, so that mixing and scattering of developer can be prevented.

Preferably, the fixing means for respective color components provided at the outer periphery portion of the photoreceptor drum fix the developed image to the sheet at their prescribed fixing temperatures. Temperatures are set to be gradually higher in the feeding direction of the sheet. Therefore, when toner not fixed at a downstream fixing device is to be fixed at a next fixing device and the toner having a different hue is superimposed on toner to be fixed first, the underlying toner does not absorb heat more than necessary from that fixing device. As a result, colors are mixed in a satisfactory manner, a hue obtained after fixation is just as desired, and unfixation of an image can be surely prevented.

In another aspect of the present invention, the stationary photoreceptor drum of the image forming apparatus above can be rotated when an image is not formed. Since the stationary photoreceptor drum is rotatable and is rotated in a prescribed cycle, influence of heat on the photoreceptor drum does not concentrate on a particular portion of the drum, thereby completely eliminating the influence of heat on the photoreceptor drum. As a result, life of the photoreceptor drum can be made longer.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
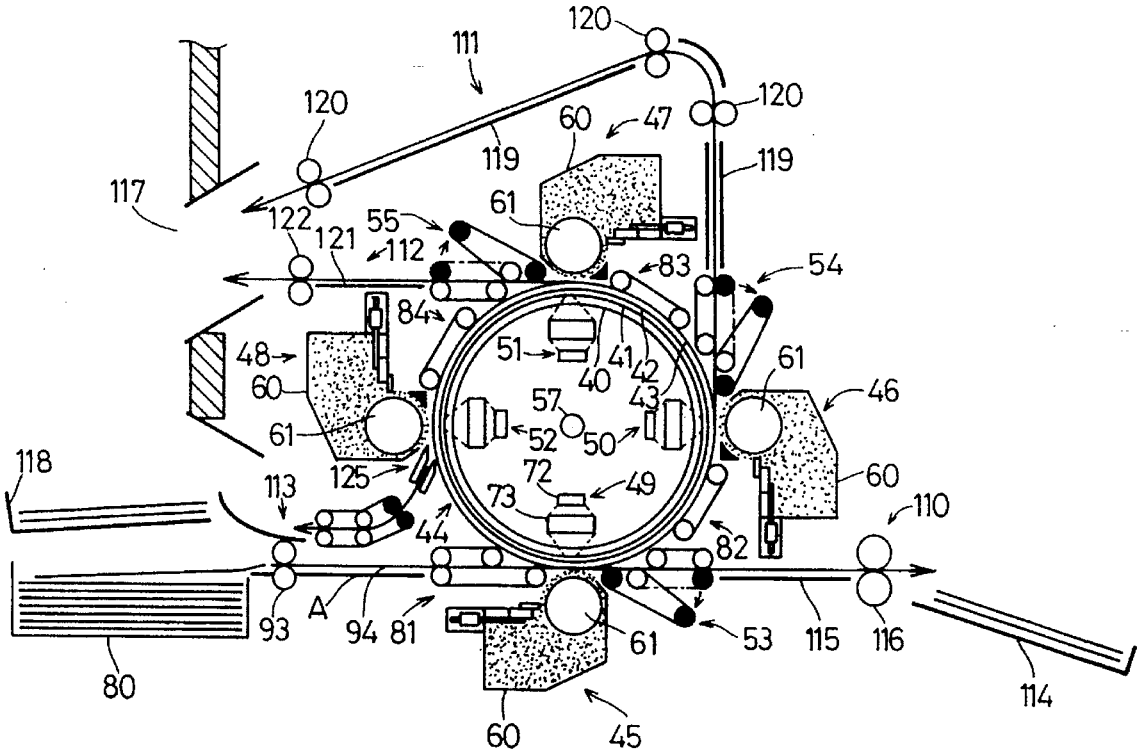
FIG. 1 shows an overall structure of a printing device of one embodiment of the present invention.

Referring to FIG. 1, a printing device, a specified form of an image forming apparatus in accordance with the present invention, includes a cylindrical photoreceptor 44 and first through fourth developing devices 45–48 provided at an outer periphery of photoreceptor 44 and having different hues. Photoreceptor 44 includes a transparent support member 40, a transparent conductive layer 41, an optical semiconductor layer 42, and an insulation layer 43, stacked in this order. Image information is externally applied and converted to a prescribed signal. Inside photoreceptor 44, first through fourth exposure units 49–52 are provided for directing light controlled by the converted signal to photoreceptor 44. Exposure units 49–52 are provided opposing to developing devices 45–48 with photoreceptor 44 posed therebetween. The printing device also includes a sheet feeding unit for feeding a sheet A counterclockwise along photoreceptor 44, first through fourth fixing units 53–56 corresponding to developing devices 45–48 respectively, an ejection unit for ejecting sheet A on which an image is formed, and a peeling unit for peeling sheet A from photoreceptor 44 before ejection.

Transparent support member 40 of photoreceptor 44 is made of such conventional optically transparent material as glass or celluloid, and has a cylindrical shape. Transparent conductive layer 41 is a sputtered film of $In_2O_3$, $SnO_2$, or the like and has a thickness of approximately 0.01 μm–1 μm. Optical semiconductor layer 42 is a deposited film of photoconductive material or a binder crystal film such as Se, ZnO, CdS, and amorphous Si, and has a thickness of approximately 1 μm–100 μm. Insulation layer 43 is an organic insulation film of polyethylene telephtalate film or the like, or an oxide insulation film of $SiO_2$ or the like, and has a thickness of 0.01 μm–10 μm.

Transparent support member 40 of photoreceptor 44 is rotatably supported to the main body of the apparatus through a rotating axis 57, and a driving portion for rotating photoreceptor 44 is provided. The driving portion is formed by a photoreceptor rotating motor 58, to which rotating axis 57 is linked through a gear, a belt or a pulley.

Each of the developing devices 45–48 is constituted by a development tank 60, in which a development roller 61 formed by a metal roller or a magnet roller, and a stirring roller (not shown) are rotatably provided. Development roller 61 is positioned facing through an opening of development tank 60 and spaced apart from, photoreceptor 44. Developing devices 45–48 are provided at the outer periphery of photoreceptor 44 at an interval of 90°, and contain two-component developer or one-component developer. Hues of developer are black, yellow, magenta, and cyan, and black developer is contained in first developing unit 45 located most upstream (at the lowest position in the figure) in the direction of feeding the sheet. The order of other three colors of developer is arbitrary. This is because a black and white image is needed frequently and promptly. Printing speed is improved by putting black developer in first developing unit 45 at which an image is formed first.

The developer contained in developing devices 45–48 is formed of carrier and toner if it is two-component developer, and carrier formed of magnetic material has on the surface thereof a resin coated layer for suppressing adhesion of toner. When carrier and toner are stirred by the stirring roller, the toner is charged by friction. The carrier is attracted to development roller 61 by magnetic force, thereby forming a magnetic brush. When it is transported, the toner attached to the carrier by Coulomb's force is transported. The brush height of the magnetic brush is restricted to a set height by a doctor 62 (in FIGS. 2A and 2B) for adjusting the height, and there is a very small space between the tip of the developer and photoreceptor 44. The brush height is adjusted so that the space disappears when sheet A is fed to a development region between photoreceptor 44 and development roller 61, in the range of 10–100% of the thickness of sheet A. By contrast, one-component developer is formed only by toner, which has two types: magnetic toner containing magnetic powder therein and non-magnetic toner containing no magnetic powder therein. The toner is attached to the development roller by applying a voltage to the development roller with a voltage applying device (not shown), and then transported. The brush height of the toner is restricted to a set height by the doctor, similarly to two-component developer.

Each of developing devices 45–48 also includes a container bottle (not shown) for supplementary toner. At a portion of the bottle, a supplementing roller is provided for supplementing toner to development tank 60. For two-component developer, the amount of toner corresponding to the used amount is supplemented in response to an on and off signal of a toner concentration sensor, thereby keeping constant the concentration of the toner in development tank 60. For one-component developer, the amount of developer in the development tank is detected by a volume detecting sensor installed in the tank, whereby toner is supplemented in a manner controlled by the developer supplementing roller so that a certain amount of the developer is constantly contained in the tank.

In order to obtain an image with a desired hue, each developer of developing devices 45–48 has a softening temperature which becomes gradually higher in the sheet feeding direction. In other words, the difference in softening temperatures between the first developer and the last developer is adjusted to be in a range of 5°–100° C. by changing mixture ratio of components of developer, that is resin, anti-static agent, and the like.

Figure 2A:
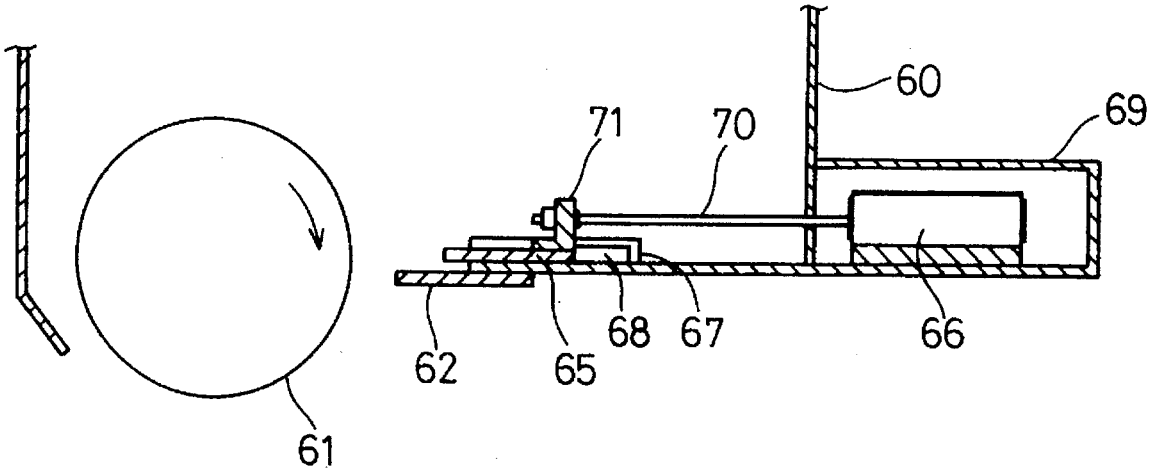
FIGS. 2A and 2B are a cross sectional view and a plan view, respectively, showing a shutter of a developing device.
Figure 2B:
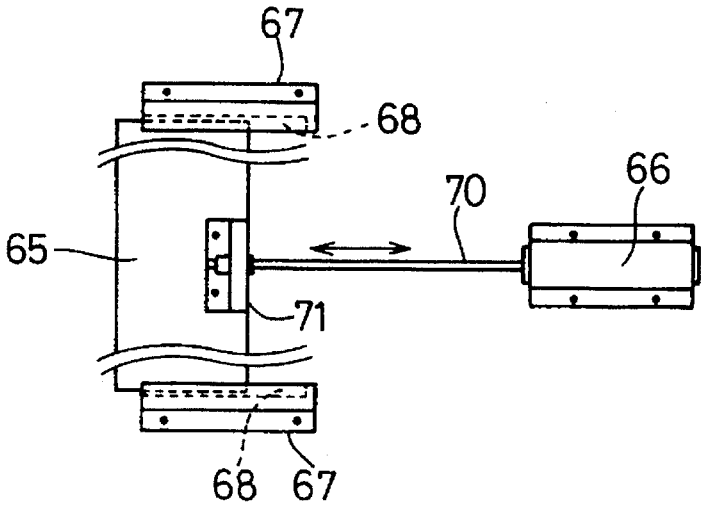

Referring to FIGS. 2A and 2B, developing units will be described in detail. If developer is brought near photoreceptor 44 when developing devices 45–48 are driven, toner would be scattered, possibly damaging sheet A. In order to prevent this scattering, a movable shutter 65 which is brought into contact with and separated from development roller 61 to stop supplying developer to development roller 61, and a solenoid 66 for moving shutter 65 are provided. Shutter 65 is slidably disposed in development tank 60 at a position upstream to doctor 62 in the direction of feeding the developer, and is formed by a flat plate having a width substantially same as the length of development roller 61. On both sides of shutter 65, a guide plate 67 for guiding shutter 65 in a radial direction of development roller 61 is provided so that shutter 65 contacts development roller 61 at a right angle. Both ends of shutter 65 are slidably engaged to a groove 68 in each guide plate 67. Solenoid 66 is contained in a housing 69 mounted on an outer surface of development tank 60, and has a rod 70 penetrating the wall of development tank and attached to an L-shaped member 71 disposed on an upper surface of shutter 65. Solenoid 66 turns on when no image is developed, and shutter 65 contacts development roller 61, thereby stopping the flow of developer. As an alternative mechanism to the solenoid for moving shutter 65, a spring can be used to press shutter 65 onto development roller 61, and a motor and a cam can be used to separate shutter 65 from development roller 61.

Referring again to FIG. 1, exposure units 49–52 are each formed by an integrated body of an LED head 72 having many light emitting diodes and a lens 73 for forming an image on optical semiconductor layer 42 with light emitted from LED head 72. LED head 72 emits light in response to image data from, for example, a reader for reading an original sheet.

Figure 3:
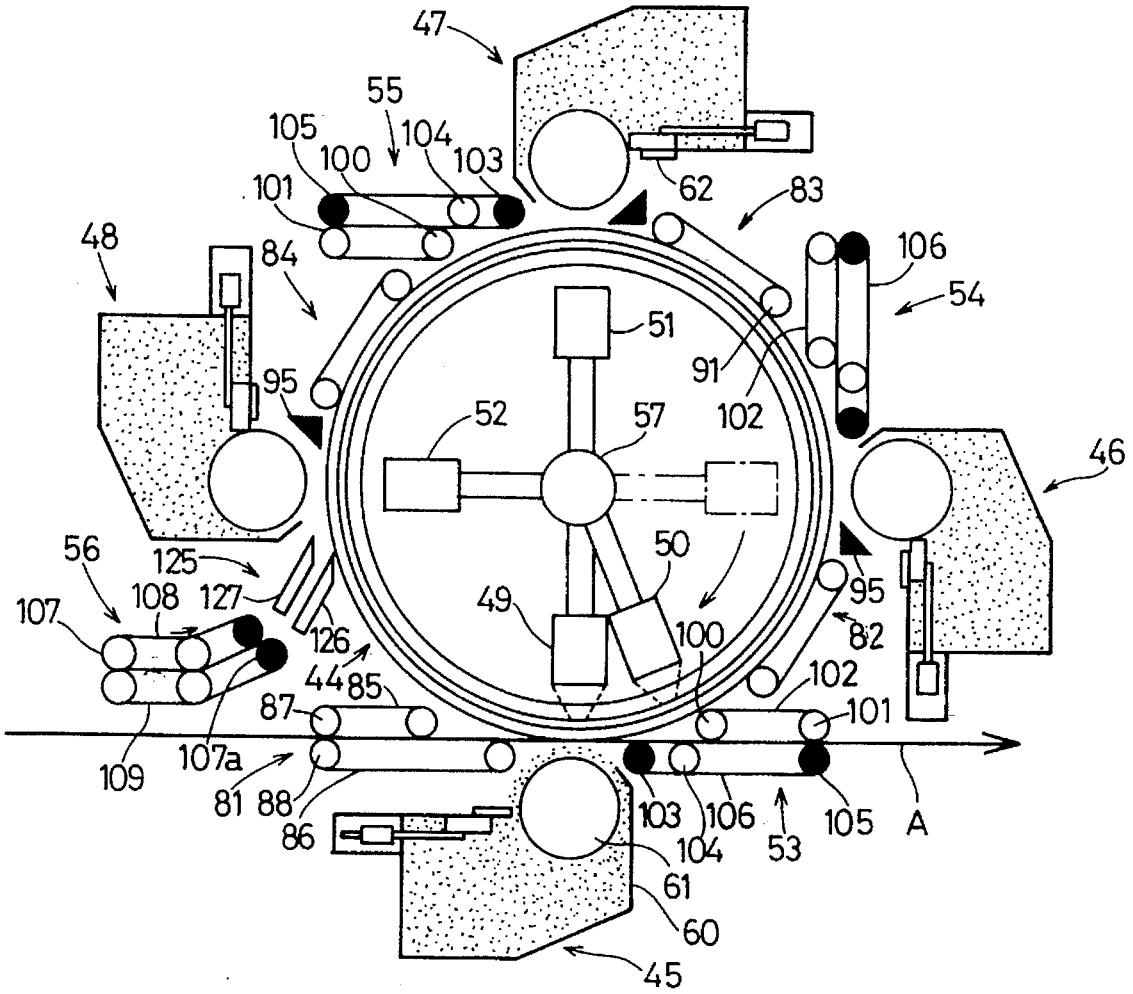
FIG. 3 shows a structure of the printing device in a state where an exposure unit has moved.

Referring to FIGS. 1 and 3, the feeding unit will be described. The feeding unit for feeding the sheet includes a first feeding unit 81 for feeding sheet A from a paper feeding cassette 80 to first developing unit 45, a second feeding unit 82 for feeding the sheet from first developing unit 45 to second developing unit 46, a third feeding unit 83 for feeding it from second developing unit 46 to third developing unit 47, and a fourth feeding unit 84 for feeding it from third developing unit 47 to fourth developing unit 48. Sheet A can also be supplied from a manual feed tray (not shown) to first feeding unit 81.

First feeding unit 81 includes a pair of upper and lower belts 85 and 86, and pairs of right and left rollers 87 and 88 around which respective belts 85 and 86 are wound. The roller located upstream in the feeding direction is linked to a driving motor 89 through a gear, a belt, or the like and driven by the motor, and the other roller follows the rotation of the upstream roller. As a result, upper belt 85 rotates counterclockwise, and lower belt 86 rotates clockwise, whereby sheet A is fed through the space between upper and lower belts 85 and 86.

Second through fourth feeding units 82–84 are formed by a belt 90 and a pair of feeding rollers 91 and 92 around which belt 90 is wound. Belt 90 is in contact with photoreceptor 44. Roller 92 located downstream in the feeding direction is linked to driving motor 89 through a gear, a belt, or the like and driven by the motor, and the other roller 91 follows the rotation of roller 92. As a result, belt 90 rotates clockwise, and sheet A is fed through the space between belt 90 and photoreceptor 44. The speed at which sheet A is fed must be the same at each feeding unit in order to avoid deviation upon feeding sheet A. Therefore, one driving motor 89 can be shared or motors can be provided individually which are controlled so that each motor has the same rotating speed. In this embodiment, one driving motor 89 is employed so as to avoid a complicated control. A paper feeding roller 93 and a guide plate 94 are provided between paper feeding cassette 80 and first feeding unit 81. A guide wall 95 is provided immediately before second and third developing devices 46 and 47 for guiding sheet A to a development region of the developing unit and preventing scattering of developer.

Referring to FIG. 3, among the fixing units, first through third fixing units 53–55 are disposed between first through third developing units 45–47 and second through fourth feeding units 82–84, respectively, and include an inner belt 102 wound around two rollers 100 and 101 and an outer belt 106 wound around three rollers 103–105. A heat generator such as a heater or a lamp is provided in rollers 103 and 105 (indicated by a black circle in the figure) at both inner and outer ends of outer belt 106. Outer belt 106 can be brought into contact with or separated from inner belt 102. The outer movable roller 105 of outer belt 106 is movably supported and moves between a position near inner belt 102 and a position separated therefrom. As a mechanism for moving the roller, the axis of movable roller 105 can be directly moved by a solenoid, or the axis of movable roller 105 can be attached to a movable piece and the supporting axis of the movable piece can be rotated by a motor.

Inner belt 102 is provided in the tangential direction of photoreceptor 44 and has one side in contact with photoreceptor 44. The upstream roller 100 is rotated in the forward and rearward directions by a motor, and the other roller 101 follows the rotation of roller 100, so that the belt rotates clockwise and counterclockwise. Outer belt 106 has middle roller 104 driven and the other rollers following the rotation of roller 104, and belt 106 rotates clockwise. Inner roller 103 is brought near photoreceptor 44, and middle roller 104 is brought near inner belt 102. In a separated state, inner belt 102 rotates clockwise, and sheet A on which an image is fixed can be fed to the next developing unit. In a contact state, inner belt 102 rotates counterclockwise, and sheet A on which an image is fixed can be ejected outside the apparatus.

Fourth fixing unit 56 is disposed downstream to fourth developing unit 48 in the feeding direction at a position spaced apart from photoreceptor 44, and it includes a pair of upper and lower belts 108 and 109 each wound around three rollers 107. A heat generator is provided in an inner roller 107*a*. One of the remaining rollers 107 is driven by a motor, and upper belt 108 rotates clockwise and lower belt 109 rotates counterclockwise. The motor of the fixing unit and driving motor 89 of the feeding unit are controlled upon driving so that the feeding speed at the fixing unit is the same as the feeding speed at the feeding unit.

Each heat generator of fixing units 53–56 has a fixing temperature gradually increased, starting from first fixing unit 53, in accordance with softening temperatures of developer. The temperature at the surface of the roller is detected by a temperature detection sensor (not shown), and is controlled based on the difference between the detected temperature and the predetermined temperature so that it is kept constant.

Referring to FIG. 1, the paper ejection unit includes a first paper ejection unit 110 for ejecting paper after an image is formed at first developing unit 45, a second paper ejection unit 111 for ejecting paper after an image is formed at second developing unit 46, a third paper ejection unit 112 for ejecting paper after an image is formed at third developing unit 47, and a fourth paper ejection unit 113 for ejecting paper after an image is formed at fourth developing unit 48. First paper ejection unit 110 is formed by first fixing unit 53 in the contact state, a guide plate 115 for guiding sheet A to first paper ejection tray 114, and a pair of upper and lower feeding rollers 116, and sheet A is ejected in the horizontal direction. Second paper ejection unit 111 includes second fixing unit 54 in the contact position, a guide plate 119 for guiding sheet A from second fixing unit 54 through ejection port 117 to second paper ejection tray 118, and a plurality of pairs of feeding rollers 120, and sheet A detours above third developing unit 47 and fed to second paper ejection tray 118. Third paper ejection unit 112 includes third fixing unit 55 in the contact position, a guide plate 121 for guiding sheet A to second paper ejection tray 118, and a pair of upper and lower feeding rollers 122, and sheet A is ejected in the horizontal direction. Fourth paper ejection unit 113 uses fourth fixing unit 56, and the sheet is guided to second paper ejection tray 118 by a guide plate 123. First paper ejection tray 114 receives sheet A on which a black and white image is formed, and second paper ejection tray 118 receives sheet A on which a multicolor or monocolor image is formed.

Now, the peeling unit will be described with reference to FIG. 3. For fourth developing unit 48, the peeling unit is formed by a peeling craw 125 disposed at the ejection side of the fourth developing unit, and for first through third developing units 45–47, it is formed by a mechanism for rotating second through fourth exposure units 50–52 to come close to a region where an image is finally developed and directing light to the entire surface. This mechanism weakens the attaching force of sheet A attached to photoreceptor 44 by, for example, electrostatic charges and makes it easier to peel sheet A from the photoreceptor. Peeling craw 125 is formed by a removal member 126 in contact with photoreceptor 44 and a guiding member 127 disposed opposing thereto at a space, and it guides sheet A peeled off photoreceptor 44 to fourth fixing unit 56.

Figure 4:
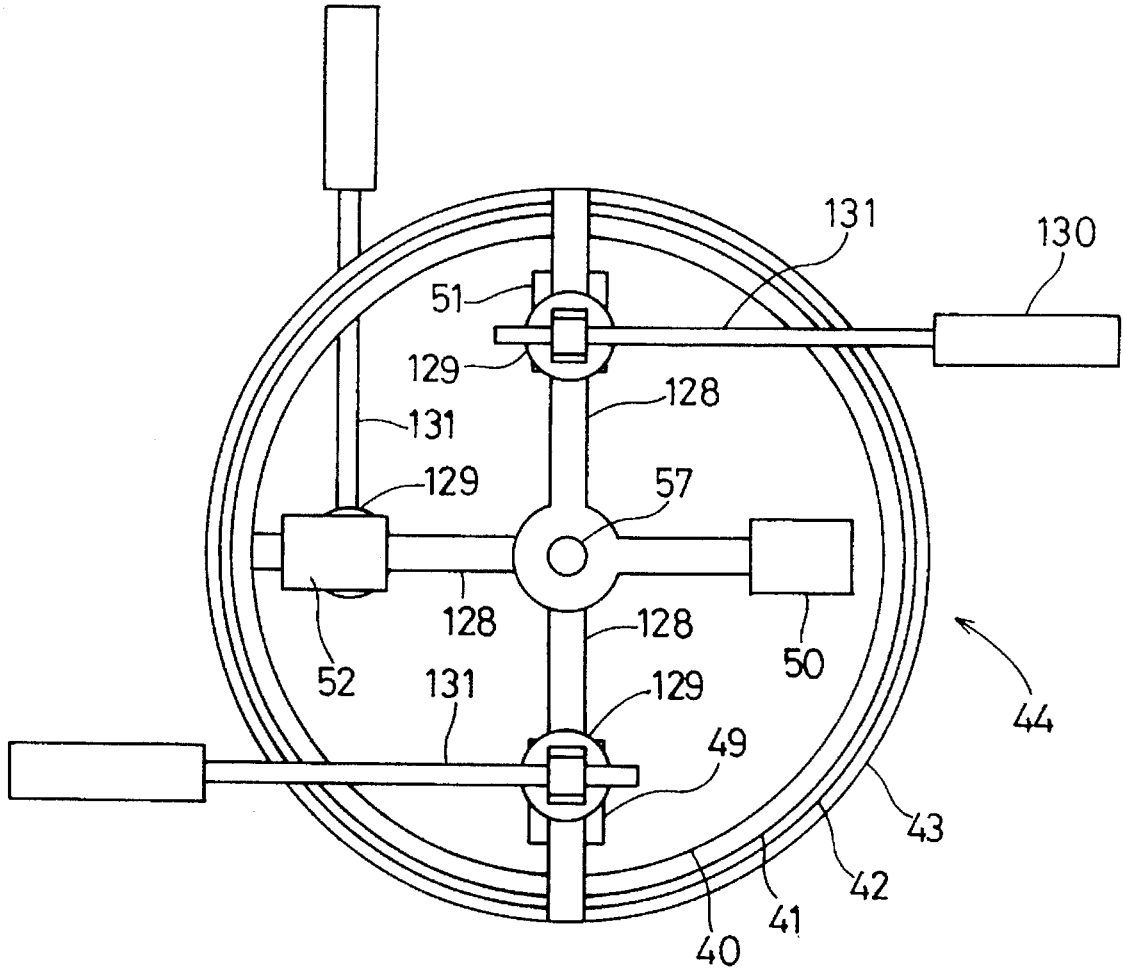
FIG. 4 shows a mechanism for moving the exposure unit.
Figure 5B:
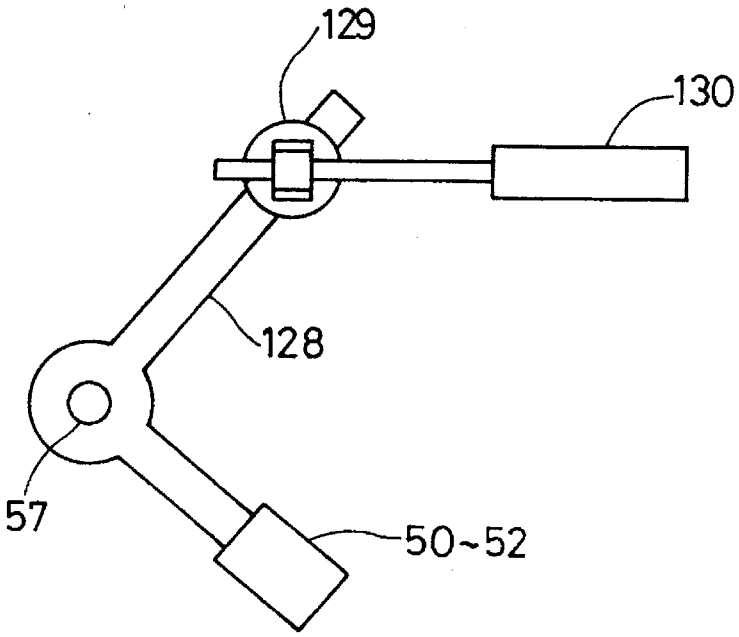
FIGS. 5A and 5B show the exposure unit before and after movement.
Figure 5A:
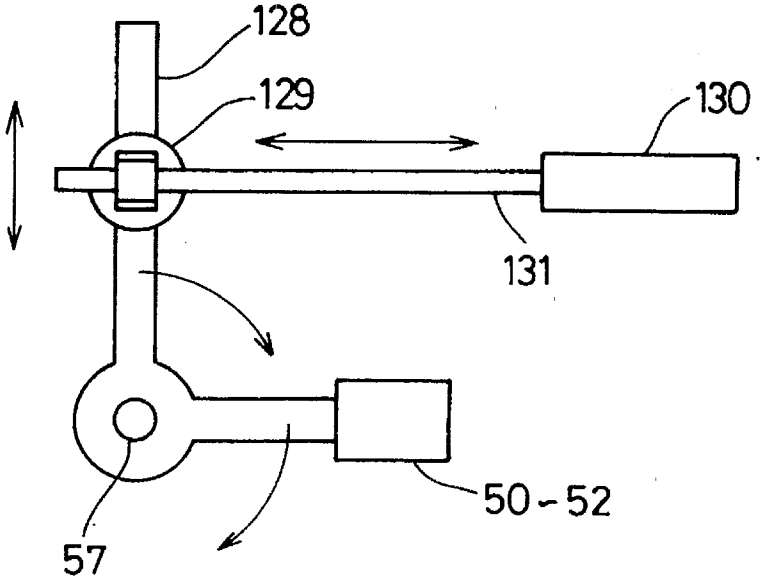

Referring to FIG. 4, a mechanism for moving the exposure unit will be described. Exposure units 50–52 are each attached on one end of an L-shaped supporting member 128, and the central part thereof rotatably fits rotating axis 57 of photoreceptor 44. A movable piece 129 is fitted to the other end side of supporting member 128, and rod 131 of a position moving solenoid 130 is rotatably attached to moving piece 129. Consequently, as shown in FIGS. 5A and 5B, as rod 131 is shortened by turning on solenoid 130, moving piece 129 moves outward along supporting member 128, thereby rotating supporting member 128 clockwise. Although first exposure unit 49 is fixed, it may be rotatably movable near fourth exposure unit 52, thereby replacing the peeling craw.

Figure 6:
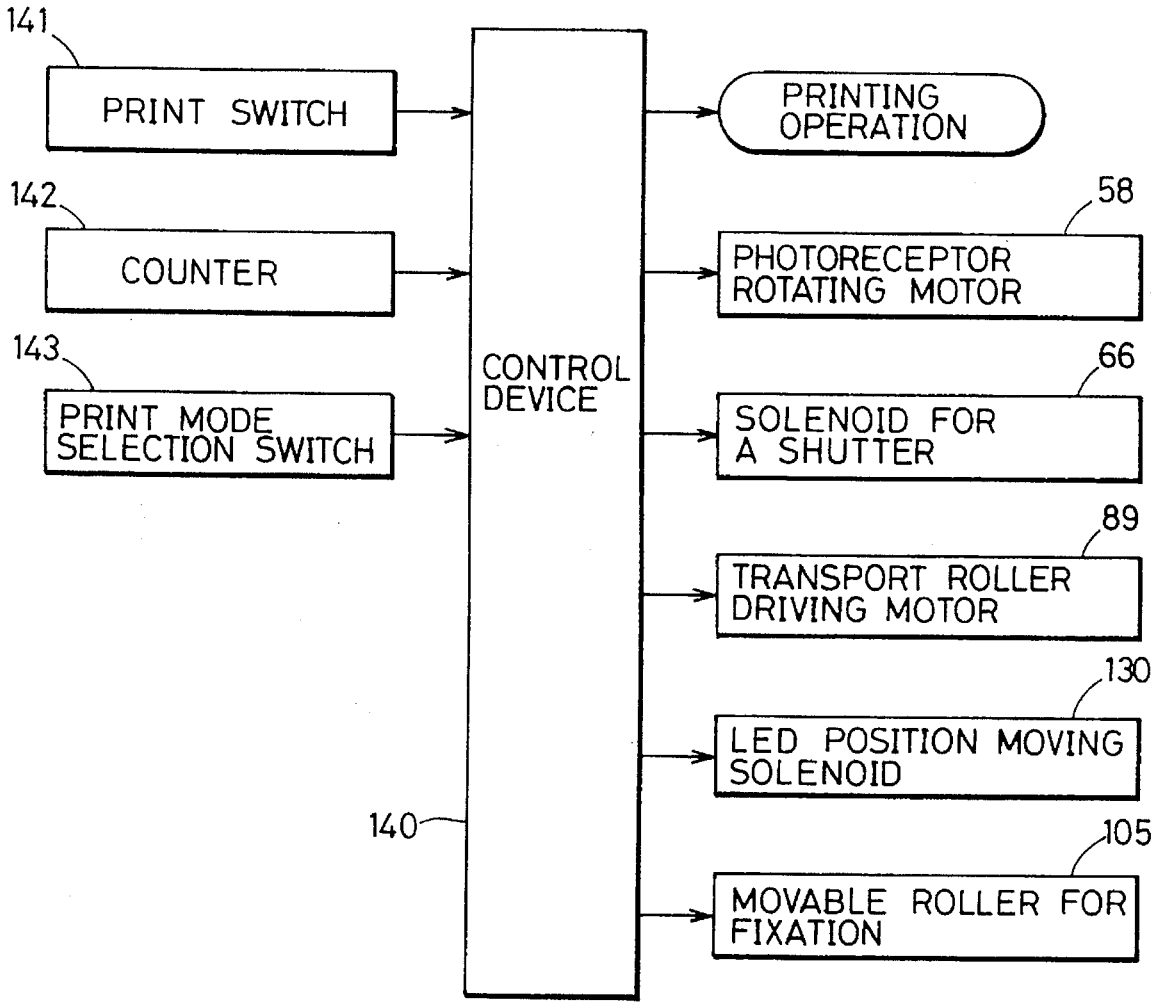
FIG. 6 is a block diagram showing how the printing device is controlled.

Next, a control device for the printing device in accordance with the present invention will be described. Referring to FIG. 6, the printing device includes a control device 140 for controlling each unit in accordance with an image forming process and also controlling the driving portion of photoreceptor 44, shutter 65, the feeding unit, the peeling unit, and the paper ejection unit in accordance with a print mode. Control device 140 has a microcomputer, and a print switch 141, a counter 142, a print mode selection switch 143 are connected thereto. At a prescribed timing, developing units 45–48 and exposure units 49–52 are driven, sheet A is fed, and an image is formed. In accordance with the selected print mode, shutter 65 of the developing units 45–48 which are not involved in development is activated. Exposure units 50–52 are moved to make it easier to peel sheet A from photoreceptor 44. Movable roller 105 of fixing units 53–55 are moved so as to eject sheet A. When the number of printed sheet reaches the predetermined number, photoreceptor 44 is rotated by a prescribed angle in the prescribed direction, thereby preventing degradation of photoreceptor 44. Each belt rotated by the rollers of fixing units 53–56 and each roller of the feeding unit are controlled to have the same speed. As a result, sheet A is fed at a fixed speed, so that the timing at which the sheet reaches each development region is fixed. By driving exposure units 49–52 in accordance with this timing, the position of the leading edge of sheet A is adjusted, thereby superimposing an image on sheet A precisely. Alternatively, the position of sheet A is detected by, for example, a paper detecting sensor utilizing an optical sensor and a lead switch, and based on the detected signal, the exposure unit is driven when sheet A reaches the development region. As described above, photoreceptor 44 is stationary while an image is formed, so that the position of the leading edge of sheet A can be easily adjusted by controlling the positions of sheet A and the developing region, thereby avoiding mispositioning of an image.

Figure 7:
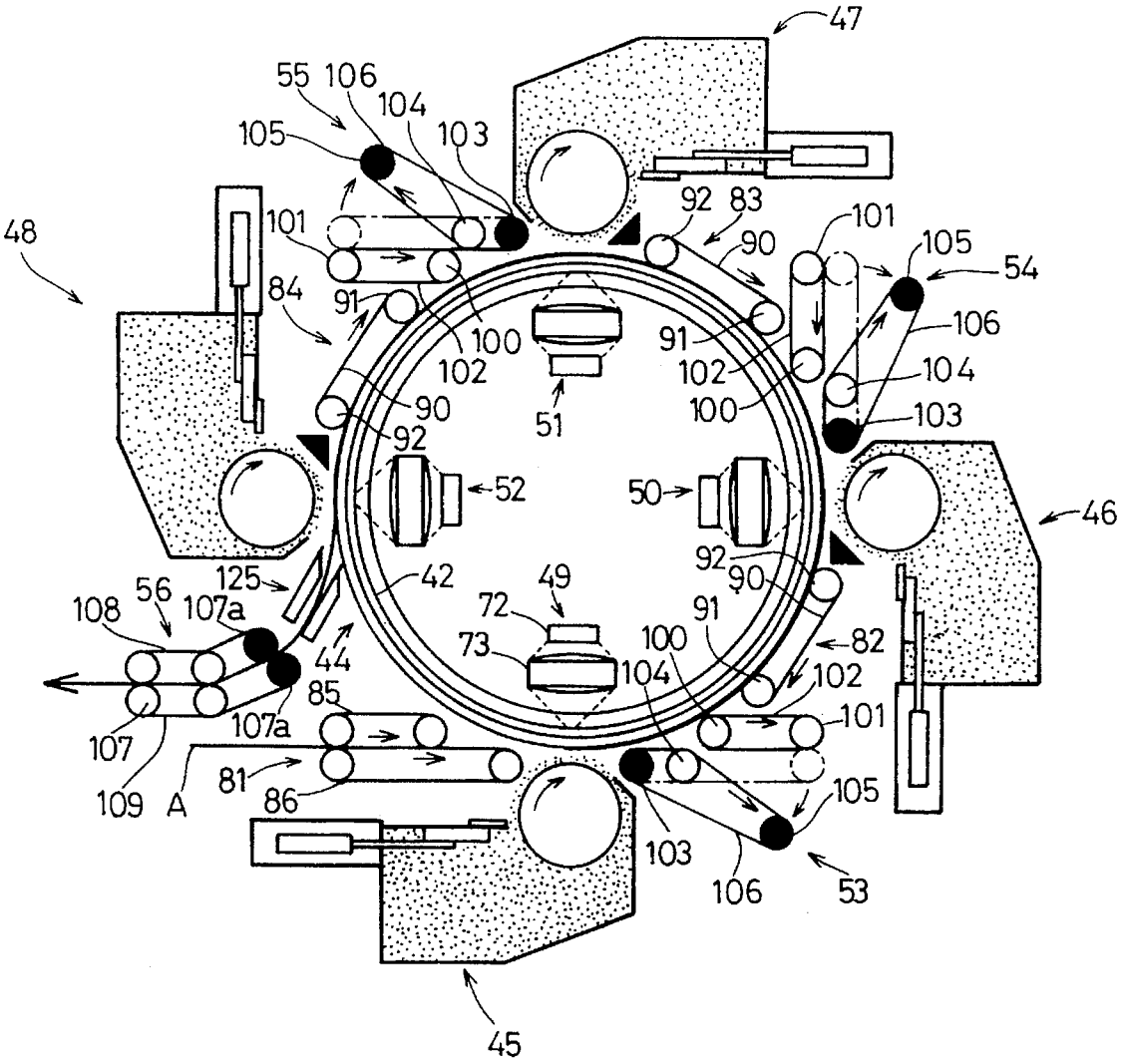
FIG. 7 shows an operating state of the printing device in a multicolor mode.

Next, printing operations of the printing device having the structure above will be described. When a multicolor mode is selected, an image formation is initiated by pressing print switch 141. As shown in FIG. 7, sheet A fed from cassette 80 is fed to first developing unit 45 by first feeding unit 81 and is inserted between photoreceptor 44 and the brush formed by developer attached to development roller 61. In accordance with this timing, LED head 72 of exposure unit 49 emits light corresponding to an image pattern, charges are introduced to optical semiconductor layer 42 of photoreceptor 44, and toner of developer is attracted to the charges with sheet A posed therebetween, so that toner is attached to sheet A and a toner image is formed. When the leading edge of sheet A reaches first fixing unit 53 while an image is developed to sheet A, toner attached to sheet A is fused by the heat from heat generator and fixed. Since first fixing unit 53 is in a separated position, sheet A on which an image is fixed is wound up by outer belt 106 and fed toward inner belt 102. The sheet is then fed along photoreceptor 44 to second feeding unit 82 and to second developing unit 46 for the next step.

Similarly, an image is developed at second developing unit 46, fixed and the sheet is fed; and another image is developed at third developing unit 47, fixed and the sheet is fed; and still another image is formed at fourth developing unit 48. Thereafter, sheet A is separated from photoreceptor 44 by peeling craw 125, guided to fourth fixing unit 56, where an image is fixed. Toner images of each color are combined, thereby obtaining a multicolor image. Sheet A is then ejected to second ejection tray 118 (in FIG. 1).

The hue of the toner in first developing unit 45 is black, and the hues of the toner in second through fourth developing units 46–48 are the three primary colors, that is, yellow, magenta, and cyan. The softening temperature of each developer must be higher from first to fourth developing units 45–48. In other words, if the softening temperature is the same and one toner is superimposed at second developing unit 46 on another toner already fixed at first fixing unit 53, the already fixed toner is not sufficiently mixed at second fixing unit 54 with the superimposed toner. As a result, the superimposed toner has an apparent hue due to transparency of that toner, and a desired hue cannot be obtained if the transparency is considerably low. Therefore, each developer must have a different softening temperature, and the fixing temperatures of fixing units 53–56 are determined in accordance with the difference in temperatures. Therefore, when the unfixed toner transferred on the sheet is fixed at fixing units 53–56, and toner having a different hue is superimposed on the toner to be fixed first, the underlying toner does not absorb heat from that fixing unit more than necessary but transmits heat to the overlying toner. As a result, both toner are mixed in a satisfactory manner, and the hue obtained after fixation will be a desired hue and unfixation of toner can be prevented, thereby obtaining an image of desired hues. Since the fixing temperatures of the sheet are different in accordance with the different softening temperatures of the developer, elongation of a sheet due to fixation can be prevented, thereby obtaining a high quality image without any misalignment of each color.

Figure 8:
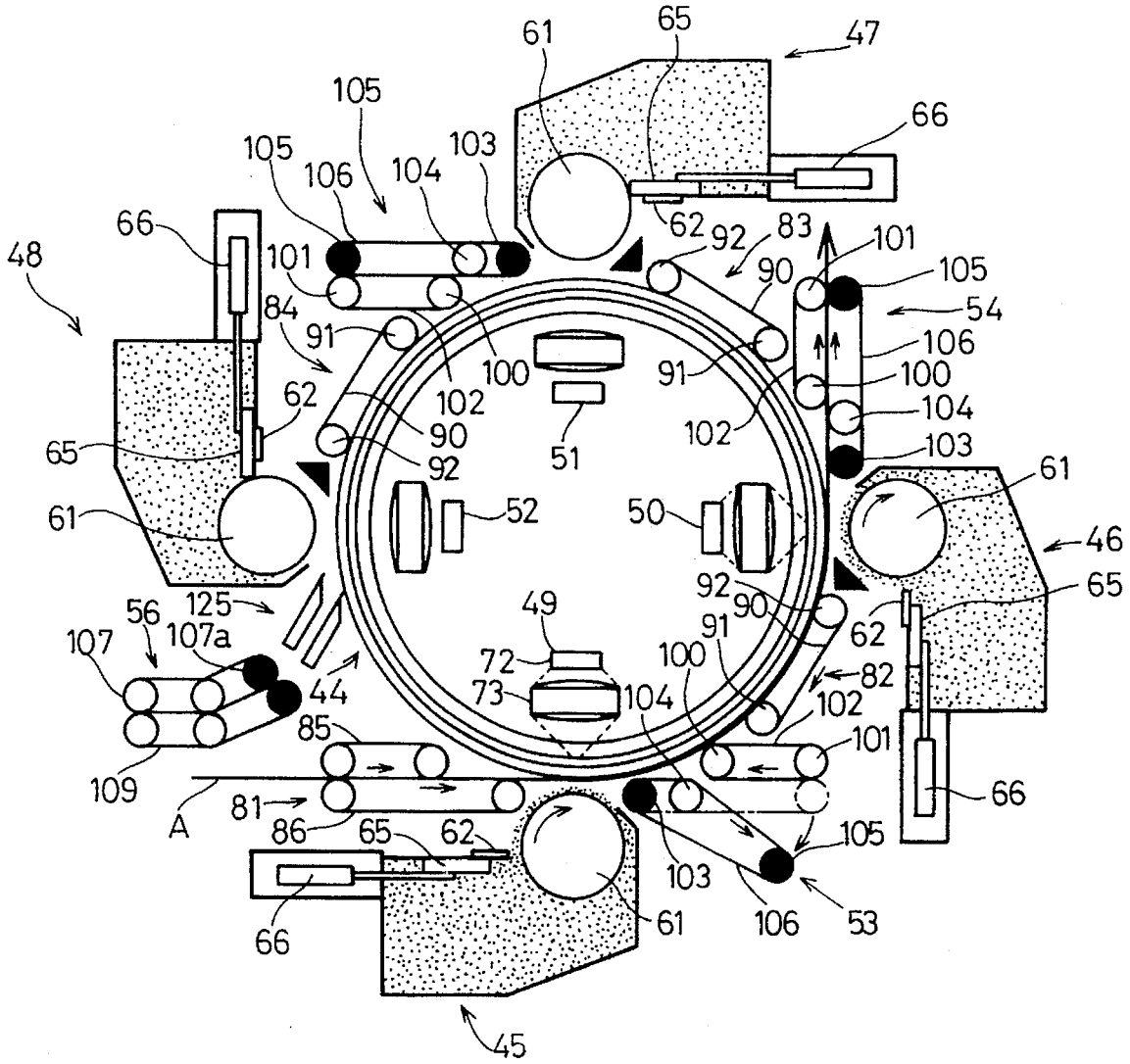
FIG. 8 shows an operating state of the printing device in a monocolor mode.

When an image is formed in a monocolor mode, any combination of colors can be selected out of four colors by print mode selection switch 143. Let us consider an example in which a color mode using only two colors obtained at first and second developing units 45 and 46 is selected as shown in FIG. 8. When print switch 141 is pressed, first fixing unit 53 is brought into a separated state, and second fixing unit 54 into the contact state. Sheet A fed from cassette 80 (in FIG. 1) is guided to first developing unit 45 and charges are introduced to photoreceptor 44. When light is emitted from LED head 72 inside photoreceptor 44 to form an image on photoreceptor 44, the image is developed with developer on sheet A, thereby forming a toner image on sheet A. The attached toner is fixed as sheet A is fed to first fixing unit 53. Sheet A on which the image is fixed is fed by rotation of inner belt 102 to second feeding unit 82, and then to second developing unit 46 for the next step.

Similarly to first developing unit 45, charges are introduced to second developing unit 46, and then an image is formed by exposure, developed, and fixed. At this time, solenoid 130 (in FIGS. 5A and 5B) for third exposure unit 51 is turned on, and third exposure unit 51 is moved clockwise to a position opposing to second fixing unit 54. This state is maintained until sheet A is ejected or until print mode selection switch 143 is pressed for the next step. LED head 72 emits light to the entire surface, so that attaching force of sheet A attached to photoreceptor 44 by static charges and the like is weakened by optical discharge effect, thereby facilitating peeling of sheet A. Sheet A is smoothly peeled off by the windup of outer belt 106. When the sheet contacts inner belt 102, it is then guided into the space between inner belt 102 and outer belt 106 by rotation thereof. Thereafter, sheet A on which two colors are mixed passes through the space between inner belt 102 and outer belt 106 of second fixing unit 54, made to detour above third developing unit 47 by second paper ejection unit 111 (in FIG. 1), and ejected to second paper ejection tray 118. If sheet A should fail to be peeled off photoreceptor 44, it is eventually peeled off photoreceptor 44 by peeling craw 125, and thus can be ejected. As described above, even when sheet A adheres to photoreceptor 44 by static charges, sheet A can be easily peeled off photoreceptor 44 by optical discharge or peeling craw 125, so that jam of paper never occurs.

At this time, third and fourth developing units 47 and 48 which are not selected in accordance with the mode are also driven. If developer contained therein is brought near photoreceptor 44, this may possibly lead to scattering of the toner. Therefore, at these developing units 47 and 48, solenoid 66 for the shutter is turned on and moves shutter 65 to be in contact with development roller 61. As a result, developer is not brought to the opening of development tank 60 even if development roller 61 rotates. Therefore, no developer exists on a portion of development roller 61 near photoreceptor 44, thereby preventing scattering of toner in advance. Since developer is not brought into contact with photoreceptor 44, photoreceptor 44 is not worn away by developer, so that degradation of photoreceptor 44 can be prevented and sheet A is not tainted by developer attached to the back surface thereof when sheet A is fed for forming a next image. In addition, unnecessary mixing of colors, a fog, and degradation of developer can be efficiently prevented.

The brush height of developer used for development is restricted by doctor 62 to be within the thickness of sheet A, and also there is a small space between photoreceptor 44 and the tip portion of developer at a development region so that the tip portion does not contact photoreceptor 44. Thus, the space is filled when sheet A is fed to the development region and photoreceptor 44 contacts developer as little as possible. As a result, when developer is supplied by rotation of development roller 61, friction with photoreceptor 44 is not generated and photoreceptor 44 is not damaged, thereby preventing degradation and deterioration in sensitivity of photoreceptor 44, and prolonging life thereof. Furthermore, unnecessary supply of developer is eliminated, leading to a reduction of a fog on a sheet and prevention of scattering of toner. When two-component developer is used, loss in carrier can be efficiently prevented.

Figure 9:
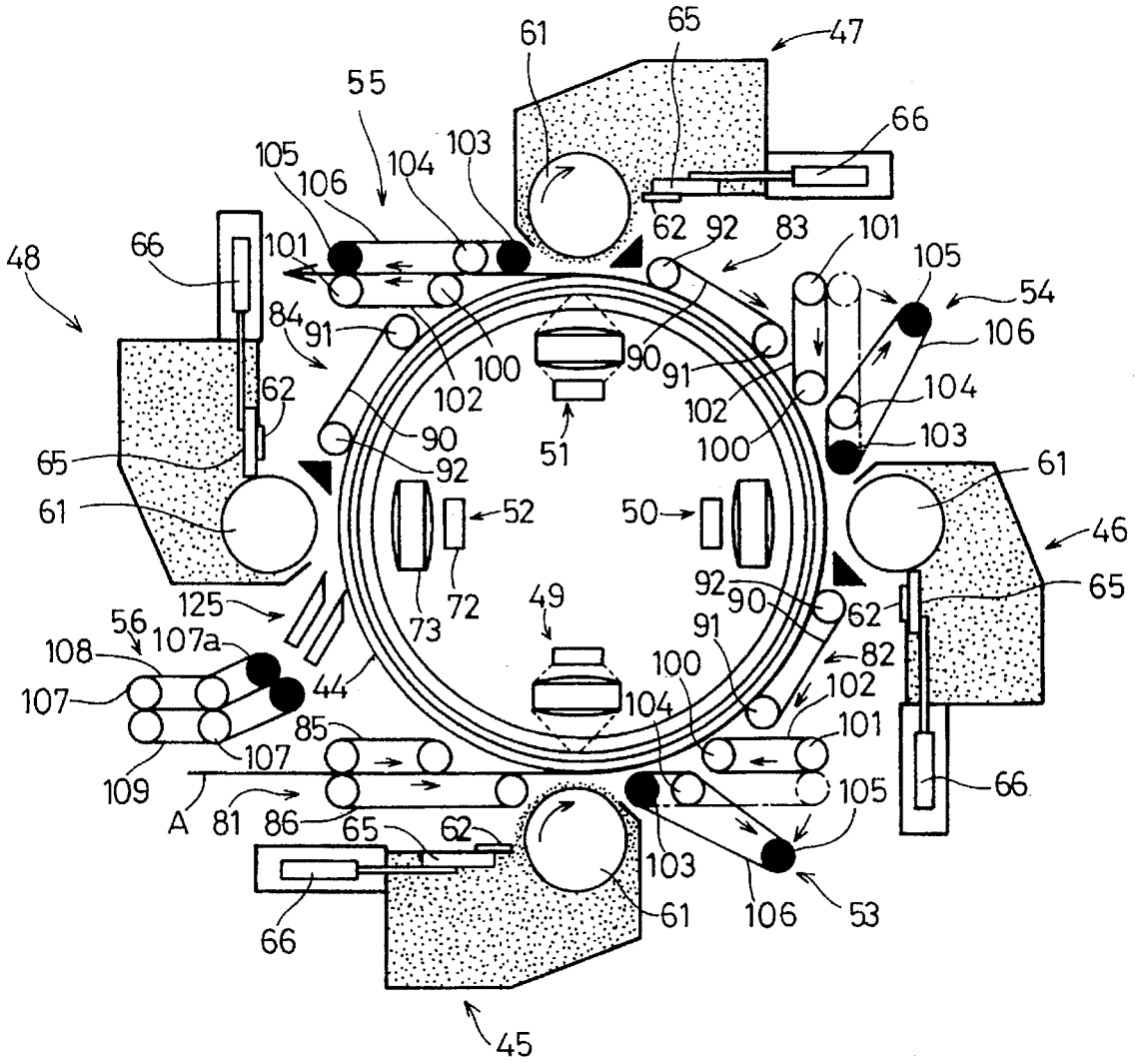
FIG. 9 shows an operating state of the printing device in anther monocolor mode.

FIG. 9 shows an operating state when a bicolor mode is selected in which images of two colors are obtained by first and third developing units 45 and 47. At this time, supply of developer to development roller 61 is intercepted at second developing unit 46 by shutter 65. After an image on sheet A is developed at first developing unit 45 and fixed, sheet A passes through the space between second developing unit 46 and photoreceptor 44 without any developer attached thereto, and then fed to third developing unit 47 by third feeding unit 83. After an image on sheet A is developed and fixed, sheet A is ejected to second paper ejection tray 118 (in FIG. 1) by third fixing unit 55 in the contact state and third paper ejection unit 112, thereby obtaining a monocolor image of two different colors.

Figure 10:
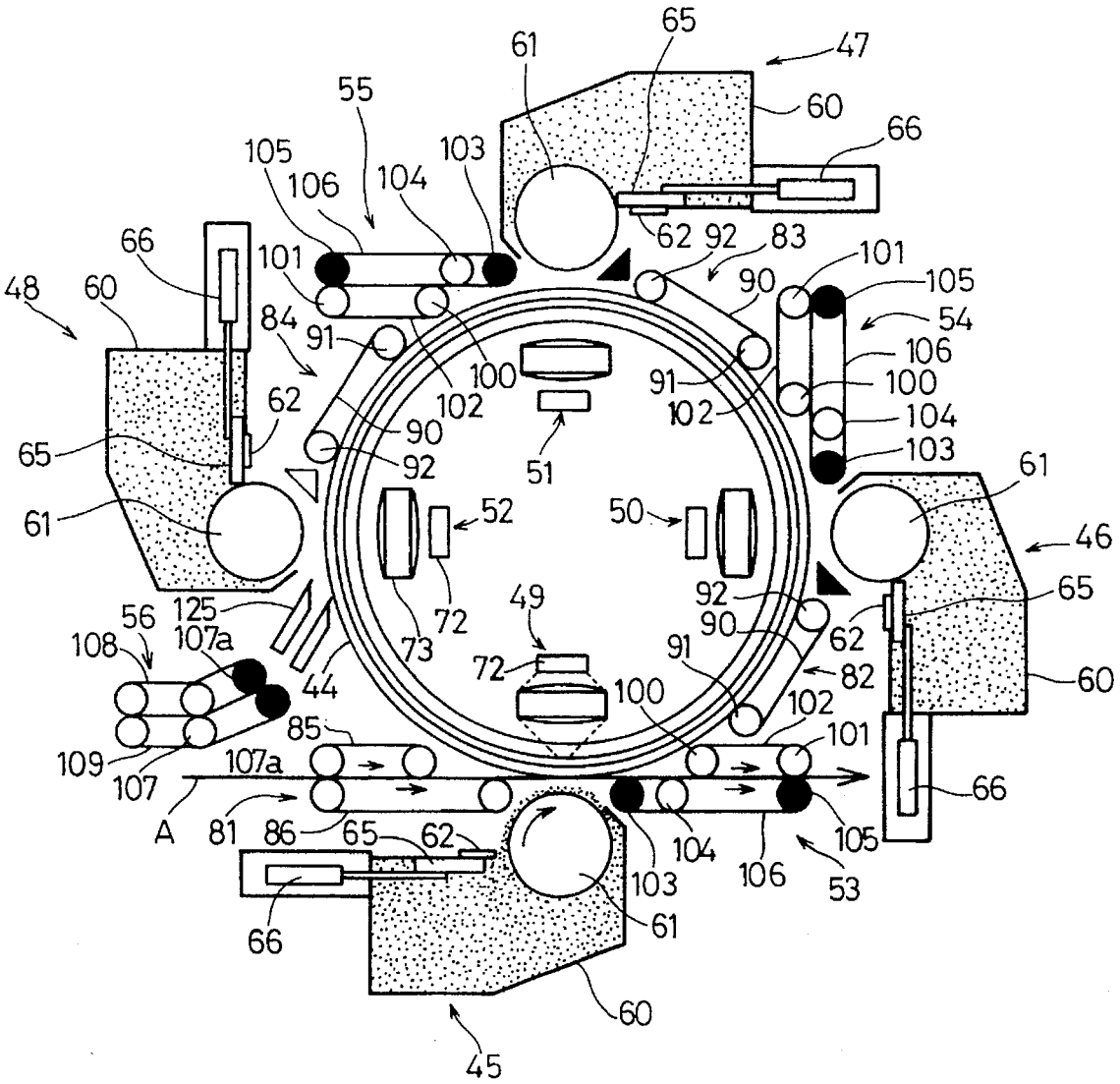
FIG. 10 shows an operating state of the printing device in another black and white mode.

Now, description will be made to a black and white mode with reference to FIG. 10. A black and white mode is selected by pressing print mode selection switch 143 and print switch 141 (in FIG. 6), thereby initiating formation of an image. Black developer is contained in first developing unit 45, and sheet A fed from cassette 80 (in FIG. 1) is guided to a development region of first developing unit 45 by first feeding unit 81. Charges are introduced to photoreceptor 44, and light is emitted from LED head 72 inside photoreceptor 44 to form an image, which is then developed with developer. Sheet A to which toner is attached is peeled off photoreceptor 44 by optical discharge of second exposure unit 50 which has moved to the proximity of first developing unit 45. The sheet is then fed to first fixing unit 53 in the contact position, the image is fixed thereon, and the sheet passes through the space between inner belt 102 and outer belt 106 and ejected to first paper ejection tray 114 (in FIG. 1).

At this time, although the other developing units 46–48 which are not selected in accordance with the black and white mode are also driven, supply of developer therein is intercepted by shutter 65 which moves to be in contact with development roller 61, thereby preventing scattering of toner beforehand. Sheet A is ejected to first paper ejection tray 114 (in FIG. 1) in the black and white mode, and to second paper ejection tray 118 (in FIG. 1) in other modes, thereby eliminating the need for providing many trays outside the apparatus and facilitating classification of images in accordance with the print mode, so that sheet A can be easily handled. Since black and white images and colored images can be handled separately, efficiency in managing documents is improved. A complicated feeding route is not required and generation of jam is less likely, leading to a reduction in space and miniaturizing the apparatus.

As described above, an image is formed while sheet A is fed along the outer periphery of the stationary photoreceptor 44 in accordance with each print mode. Photoreceptor 44 constantly faces to developer at developing units 45–48 with sheet A posed therebetween and developer is in direct contact with sheet A. When no sheet A exists, however, there is a space less than the thickness of sheet A (10–100% of the thickness of sheet A) provided between the photoreceptor and developer. When sheet A is fed to the space between photoreceptor 44 and development tank 60, the tip portion of developer contacts sheet A. The advantages which can be obtained by the stationary photoreceptor 44 are as follows. There is no wind around photoreceptor 44 which is generated by its rotation, thereby preventing scattering of toner. Photoreceptor 44 is not damaged nor worn away by the contact of the rotating photoreceptor 44 and the other components. Since photoreceptor 44 is not in direct contact with developer, it does not degrade from fatigue, and life thereof can be made the same as or longer than that of the apparatus. As a result, photoreceptor 44 can be fixed to the apparatus, eliminating the need for replacement of the photoreceptors, so that maintenance operations can be reduced.

As there is no toner on photoreceptor 44 and a toner image is formed on a surface of a sheet which does not face photoreceptor 44, photoreceptor 44 does not degrade due to heat history. Otherwise, the toner would adversely affect photoreceptor 44 due to a slight increase in temperature of photoreceptor 44 caused by a heat source for fixation and would degrade photoreceptor 44 eventually.

Figure 11:
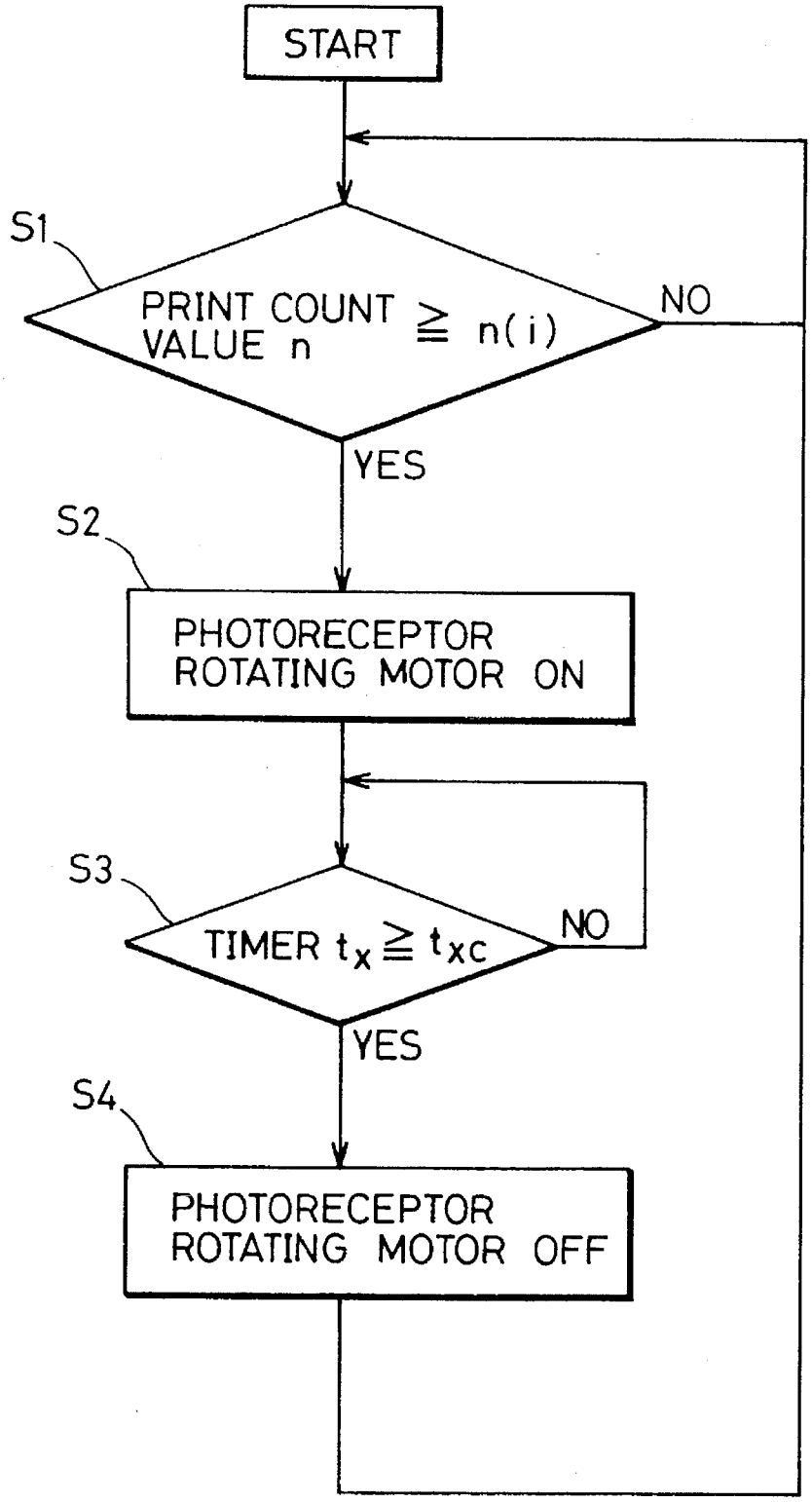
FIG. 11 is a flow chart of a rotation cycle of a photoreceptor.
Figure 12:
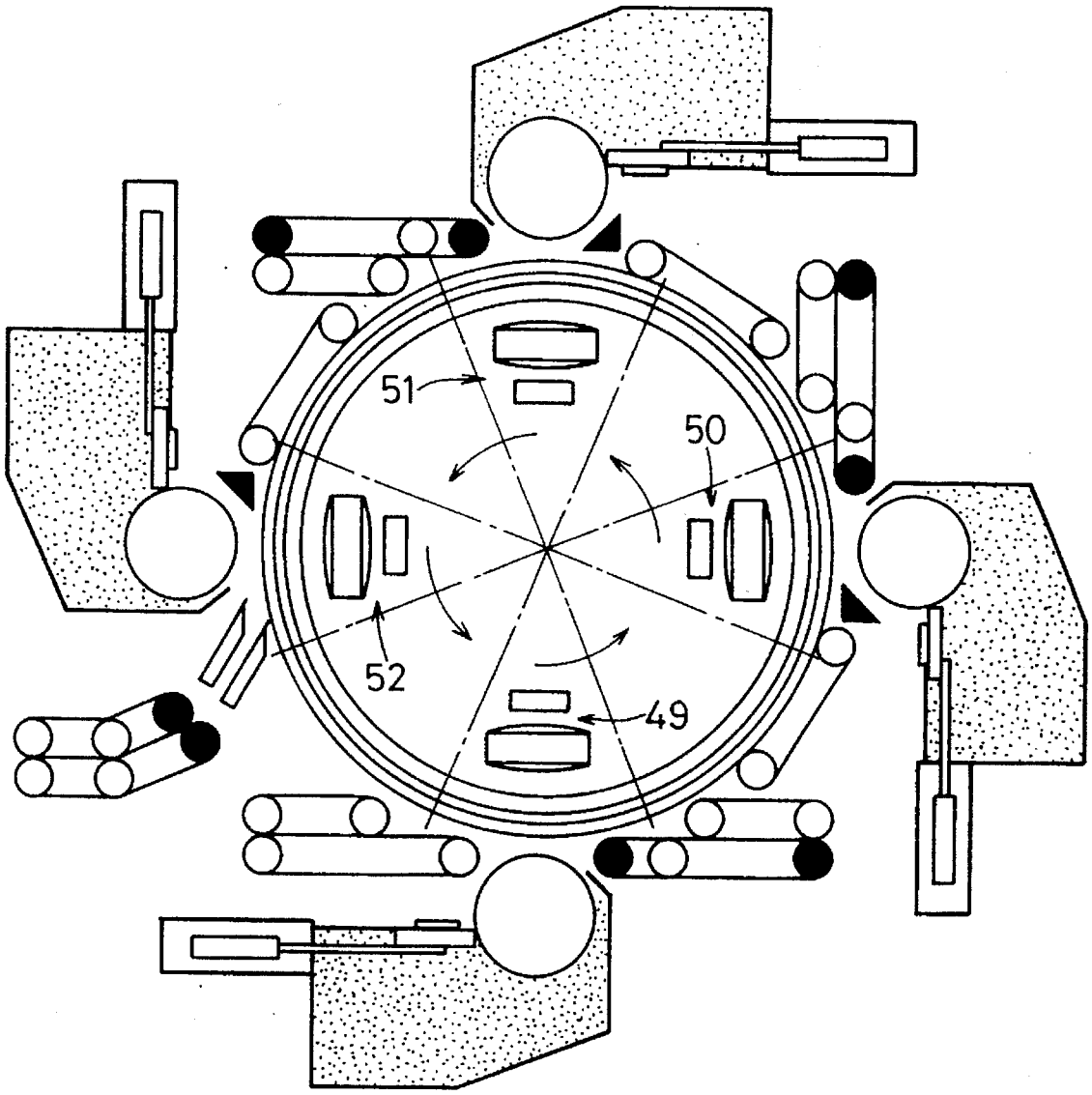
FIG. 12 shows a structure of the printing device when the photoreceptor rotates.
Figure 13:
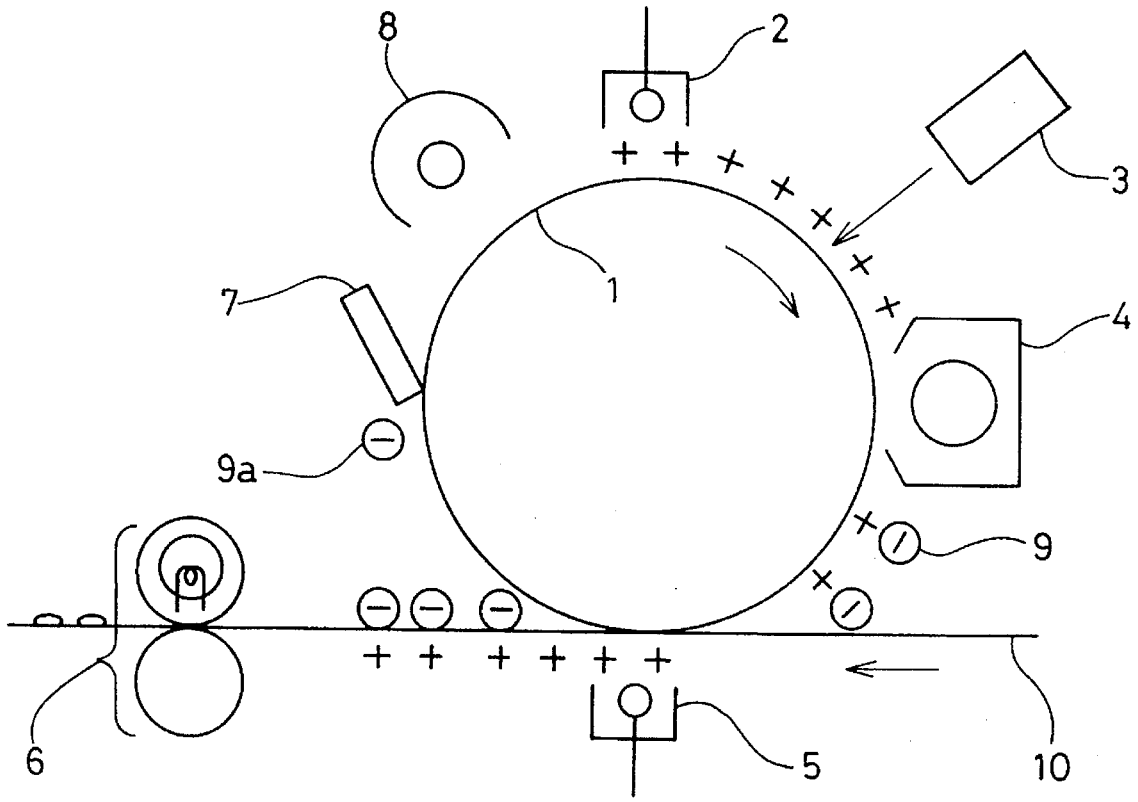
FIG. 13 PRIOR ART
FIG. 13 schematically shows a conventional electrophotographic apparatus utilizing Carlson process.
Figure 14A:
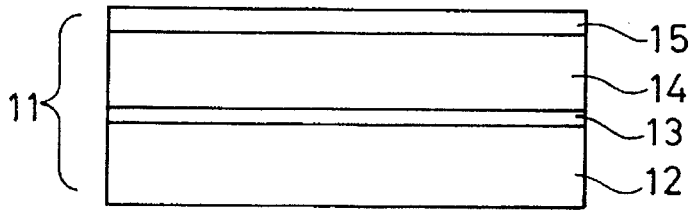
FIG. 14A PRIOR ART
FIGS. 14A–14C show a cross section of a conventional photoreceptor, principle of conventional image forming method, and an embodiment of the conventional image forming method, respectively.
Figure 14B:
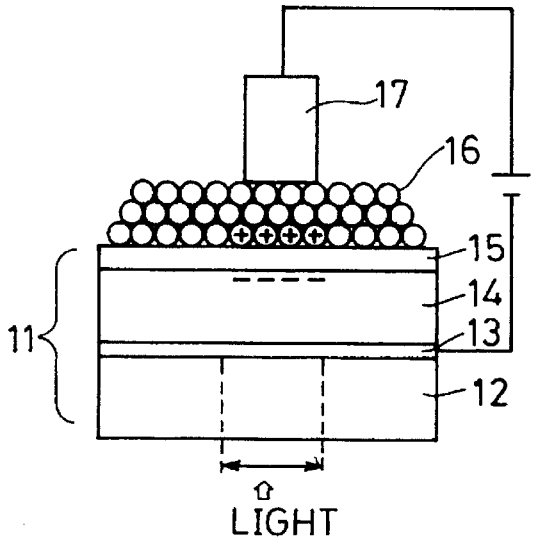
FIG. 14B PRIOR ART
Figure 14C:
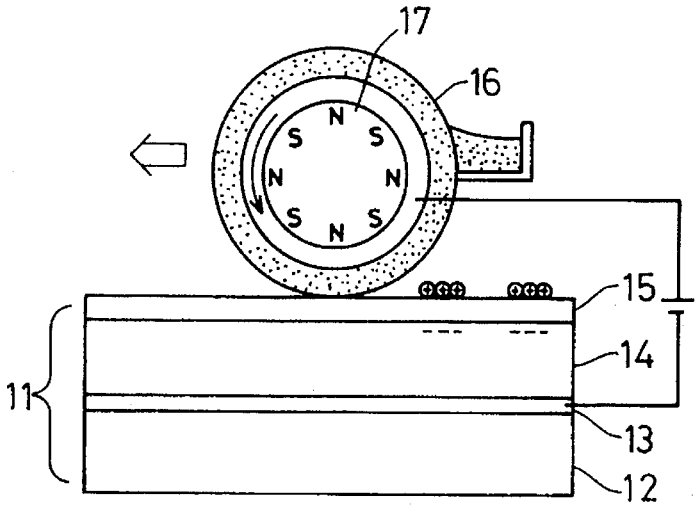
FIG. 14C PRIOR ART
Figure 15:
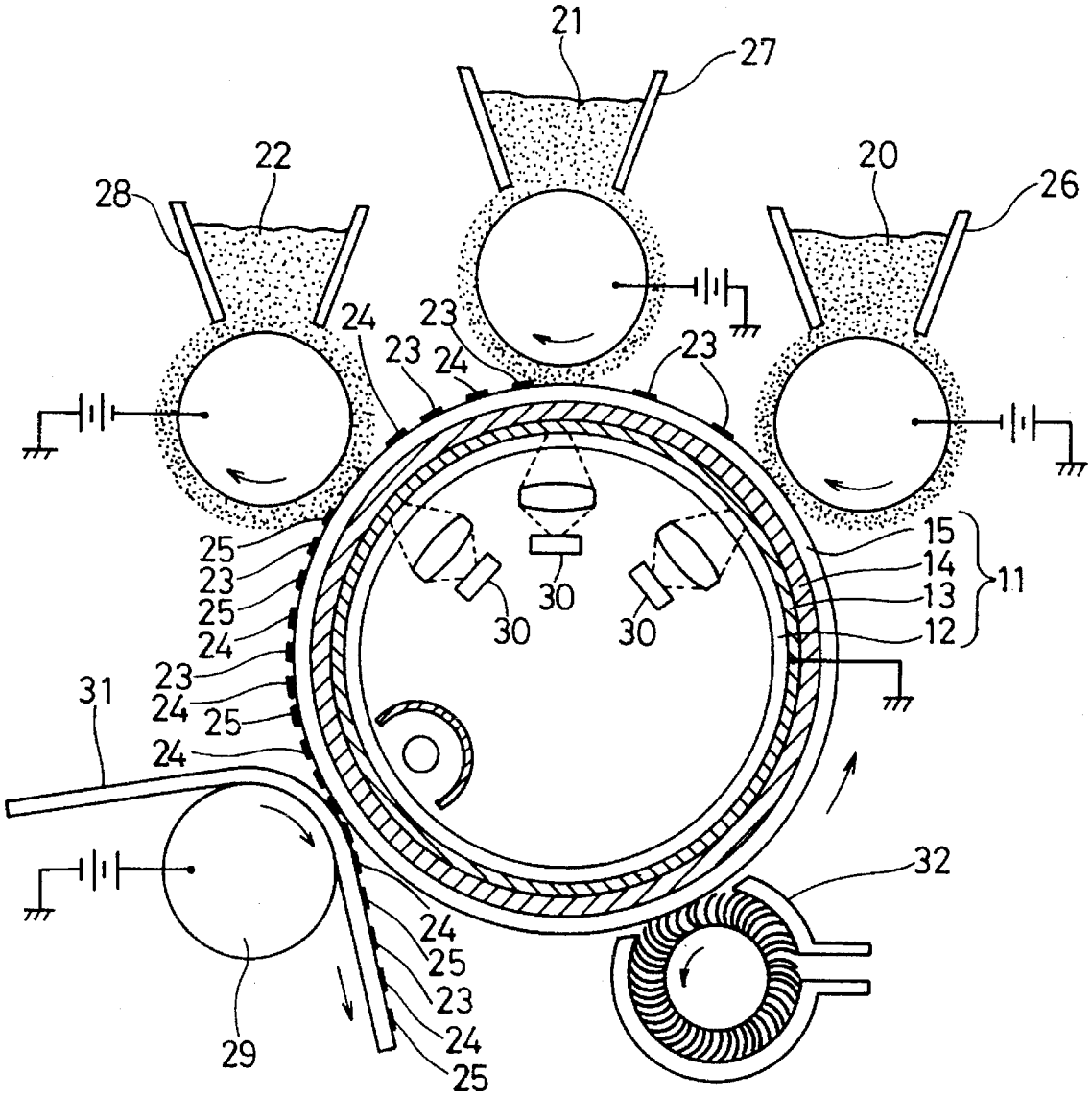
FIG. 15 PRIOR ART
FIGS. 15 and 16 show structures of conventional apparatuses for forming a color image.
Figure 16:
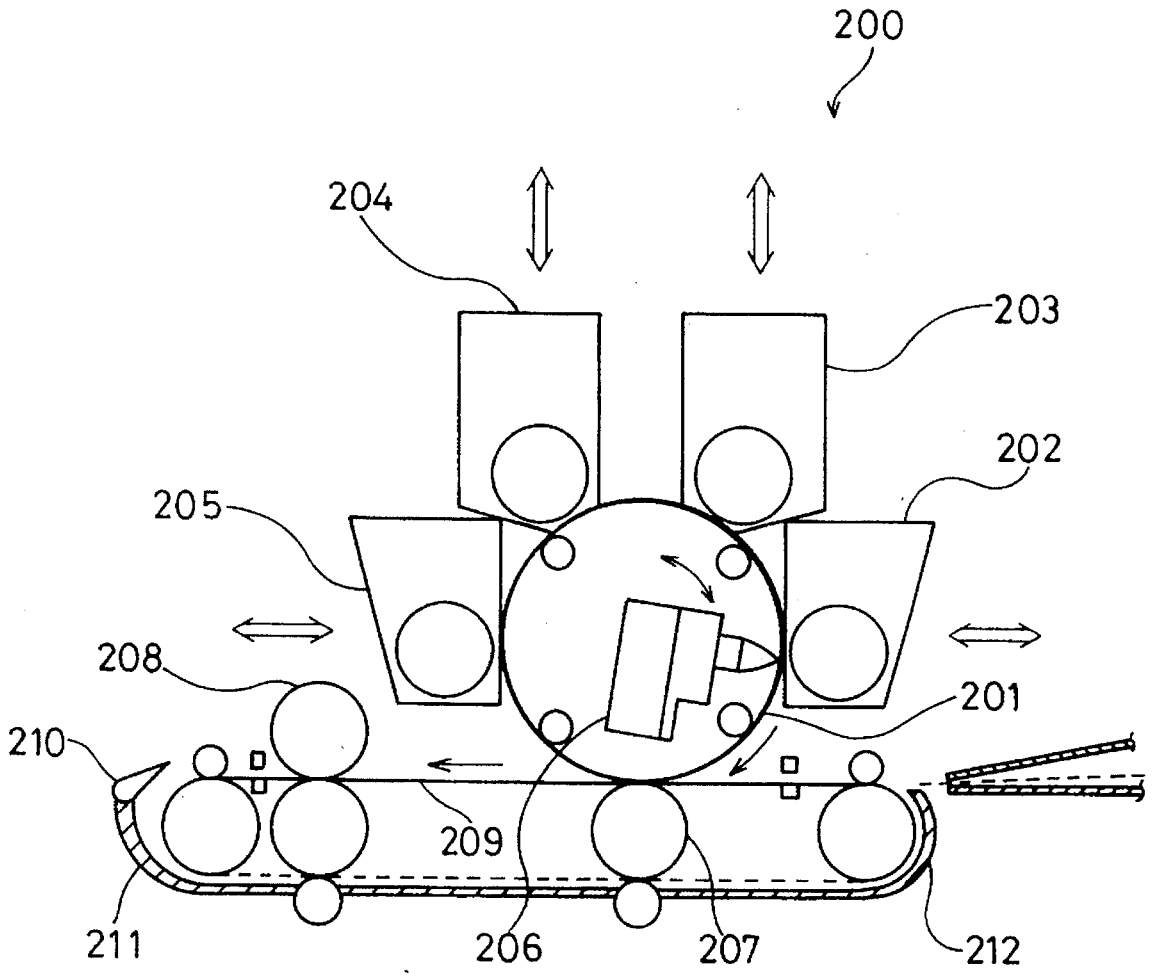
FIG. 16 PRIOR ART

If photoreceptor 44 is used in the same position for a long period of time, however, it may possibly degrade by the heat transmitted from the fixing unit. A mechanism for solving this problem will be described with reference to FIG. 11. As shown in the flow chart of FIG. 11, a counter 142 counts the value of print count each time an image is formed and a print count value n is compared with the predetermined switch count value n (i) (S1). An accumulated number of printed times at which the photoreceptor should be rotated is determined. This value is set as switch count value n (i). A plurality of values n (1), n (2), . . . n (x) are stored in a storing portion of control device 140, and successively read out in the process of (S1) in accordance with a parameter i. When print count value n reaches switch count value n (i), photoreceptor rotation motor 58 is driven (S2). The driving time equals to a set time $t_{XC}$ of the timer stored beforehand in control device 140. When kept conductive for this time period, photoreceptor 44 is rotated counterclockwise by a prescribed angle (45° in this embodiment) as shown in FIG. 12 (S3, S4). By repeating this operation, photoreceptor 44 does not remain in the same position but rotates in a constant cycle. As a result, influence of heat on photoreceptor 44 does not concentrate on a particular part, thereby eliminating such influence, so that photoreceptor 44 does not degrade and life thereof can be made longer.

The present invention is not limited to the above-described embodiment, and many modifications and changes can be made to the above embodiment in the scope of the present invention. Although an example of a printing device is described in this embodiment, the present invention can also be applied to a copying apparatus and a facsimile. The present invention improves performance and gives multiple functions of the above apparatuses.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising: a stationary transparent photoreceptor drum having a cylindrical shape;

exposure means provided in said photoreceptor drum for forming a desired latent image for each of prescribed color components at an outer periphery surface of said photoreceptor drum;

developing means provided at an outer periphery of said photoreceptor drum for developing the latent image for each of said prescribed color components on said drum;

a plurality of fixing means provided on the outer periphery of said photoreceptor drum and adjacent to said developing means; and means for feeding a sheet to said photoreceptor drum to pass through said exposure means, said developing means, and said fixing means in this order.

2. The image forming apparatus according to claim 1, wherein:

said developing means includes a container for retaining developer, means for supplying said developer from said container onto said photoreceptor drum, and means for stopping supply of said developer by said supply means.

3. The image forming apparatus according to claim 2, wherein:

said supply means is a roller provided opposing to said drum, and said stop means is a shutter contacting said roller.

4. The image forming apparatus according to claim 2, wherein:

when an image having a desired color is formed, said latent image is formed by said exposure means for each of said prescribed color components and developed by a corresponding one of said developing means, and supply of developer of said developing means which is not used for forming said image having the desired color is stopped by said stop means.

5. The image forming apparatus according to claim 1, wherein:

said plurality of fixing means fix said image to said sheet at their prescribed fixing temperatures, the fixing temperatures of said plurality of fixing means are set to be gradually higher in a direction of feeding said sheet.

6. The image forming apparatus according to claim 1, further comprising:

means for rotating said photoreceptor drum when an image is not formed.

7. The image forming apparatus according to claim 1, further comprising:

means provided at an outlet portion of each of said developing means for selectively guiding said sheet along or not along said photoreceptor drum.

8. The image forming apparatus according to claim 7, wherein:

said feeding means includes guide means provided at a periphery of said photoreceptor drum and in contact therewith, and said guide means is provided between said developing means.

9. The image forming apparatus according to claim 1, wherein:

four said developing means are provided.

10. The image forming apparatus according to claim 9, wherein:

said four developing means are developing means for yellow, magenta, cyan and black, respectively.

11. The image forming apparatus according to claim 9, wherein:

said sheet is fed in a tangential direction of said photoreceptor drum to a position of a first of said plurality of developing means, and the developing means provided at said first position is developing means for black.

12. The image forming apparatus according to claim 1, wherein:

said exposure means can move in said photoreceptor drum between a first position opposing to said developing means and a second position upstream to said first position in a direction of feeding said sheet.

13. The image forming apparatus according to claim 1, wherein:

said feeding means includes said fixing means.

14. The image forming apparatus according to claim 13, wherein:

said feeding means includes a pair of feeding belts provided between respective outlet portions of said developing means and capable of feeding the sheet.

15. The image forming apparatus according to claim 14, wherein:

said fixing means is provided in a pulley for driving at least one said pair of belts.

* * * * *